US011111619B2

(12) United States Patent
Davis

(10) Patent No.: US 11,111,619 B2
(45) Date of Patent: Sep. 7, 2021

(54) WASHING MACHINE APPLIANCES AND METHODS FOR OPERATION

(71) Applicant: Haier US Appliance Solutions, Inc., Wilmington, DE (US)

(72) Inventor: Paul Owen Davis, Prospect, KY (US)

(73) Assignee: Haier US Appliance Solutions, Inc., Wilmington, DE (US)

( * ) Notice: Subject to any disclaimer, the term of this patent is extended or adjusted under 35 U.S.C. 154(b) by 123 days.

(21) Appl. No.: 16/429,186

(22) Filed: Jun. 3, 2019

(65) Prior Publication Data

US 2020/0378051 A1 Dec. 3, 2020

(51) Int. Cl.
*D06F 37/20* (2006.01)
*D06F 37/32* (2006.01)

(52) U.S. Cl.
CPC ..... *D06F 37/203* (2013.01); *D06F 37/32* (2013.01); *D06F 2202/10* (2013.01); *D06F 2222/00* (2013.01)

(58) Field of Classification Search
None
See application file for complete search history.

(56) References Cited

U.S. PATENT DOCUMENTS 8,930,031 B2 1/2015 Wong et al.
2008/0178398 A1 7/2008 Darby
2011/0252577 A1* 10/2011 Kim ..... D06F 37/203 8/137
2020/0024787 A1* 1/2020 Smith ..... D06F 33/48

FOREIGN PATENT DOCUMENTS

EP 1154064 B2 6/2010

* cited by examiner

*Primary Examiner* — Cristi J Tate-Sims
(74) *Attorney, Agent, or Firm* — Dority & Manning, P.A.

(57) ABSTRACT

A washing machine appliance, as provided herein may include a cabinet, a tub housed within the cabinet, a basket rotatably mounted within the tub, a measurement device attached to the tub, a motor, and a controller. The motor may be in mechanical communication with the basket. The motor may be configured to selectively rotate the basket within the tub. The controller may be in operative communication with the motor and the measurement device. The controller may be configured to initiate an operation cycle. The operation cycle may include spinning the basket at a set dwell speed during a predetermined dwell period, measuring movement of the tub during the predetermined dwell period, determining an out-of-balance mass within the basket based on the measured movement, and halting the basket in response to determining the out-of-balance mass.

10 Claims, 5 Drawing Sheets

WASHING MACHINE APPLIANCES AND METHODS FOR OPERATION

FIELD OF THE INVENTION

The present subject matter relates generally to washing machine appliances, such as vertical axis washing machine appliances, and methods for monitoring load balance states in such washing machine appliances.

BACKGROUND OF THE INVENTION

Washing machine appliances generally include a cabinet that receives a tub for containing wash and rinse water. A wash basket is rotatably mounted within the wash tub. A drive assembly is coupled to the wash tub and configured to rotate the wash basket within the wash tub in order to cleanse articles within the wash basket. Upon completion of a wash cycle, a pump assembly can be used to rinse and drain soiled water to a draining system.

Washing machine appliances include vertical axis washing machine appliances and horizontal axis washing machine appliances, where "vertical axis" and "horizontal axis" refer to the axis of rotation of the wash basket within the wash tub. Vertical axis washing machine appliances typically have the wash tub suspended in the cabinet with suspension devices. The suspension devices generally allow the tub to move relative to the cabinet during operation of the washing machine appliance.

A significant concern during operation of washing machine appliances is the balance of the tub during operation. For example, articles and wash fluid loaded within a basket may not be equally weighted about a central axis of the basket and tub. Accordingly, when the basket rotates, in particular during a spin cycle, the imbalance in clothing weight may cause the basket to be out-of-balance within the tub, such that the axis of rotation does not align with the cylindrical axis of the basket or tub. Such out-of-balance issues can cause the basket to contact the tub during rotation and can further cause movement of the tub within the cabinet. Significant movement of the tub can cause the tub to contact the cabinet, potentially causing excessive noise, vibration and/or motion, or causing damage to the appliance.

Various methods are known for monitoring load balance of washing machine appliances. However, existing methods typically fail to account for increasing or rapid out-of-balance scenarios (i.e., imbalances). As an example, tracking tub strikes or other characteristics of a washing machine appliance may fail to reliably and/or quickly detect imbalances caused by improper water shedding from the basket to the tub. In some instances, water may become trapped or blocked within a portion of wash basket (e.g., by one or more waterproof articles). If the basket enters a ramp or acceleration phase of a cycle, such as during a spin cycle, water may fail to shed or shed unevenly from the basket. The trapped water may be difficult to detect until a high rotational speed is reached, at which point a significant imbalance is already created or the trapped water is suddenly released, which may cause instability of the rotating basket at high speeds.

Accordingly, improved methods and apparatus for monitoring load balance in washing machine appliances are desired. In particular, methods and apparatuses that provide accurate monitoring and detection prior to a high speed spin of a cycle would be advantageous.

BRIEF DESCRIPTION OF THE INVENTION

Aspects and advantages of the invention will be set forth in part in the following description, or may be obvious from the description, or may be learned through practice of the invention.

In one exemplary aspect of the present disclosure, a method of operating a washing machine appliance is provided. The method may include spinning a basket at a set dwell speed during a predetermined dwell period. The method may further include measuring movement of a tub during the predetermined dwell period, and determining an out-of-balance mass within the basket based on the measured movement. The method may still further include halting the basket in response to determining the out-of-balance mass.

In another exemplary aspect of the present disclosure, a washing machine appliance is provided. The washing machine appliance may include a cabinet, a tub housed within the cabinet, a basket rotatably mounted within the tub, a measurement device attached to the tub, a motor, and a controller. The motor may be in mechanical communication with the basket. The motor may be configured to selectively rotate the basket within the tub. The controller may be in operative communication with the motor and the measurement device. The controller may be configured to initiate an operation cycle. The operation cycle may include spinning the basket at a set dwell speed during a predetermined dwell period, measuring movement of the tub during the predetermined dwell period, determining an out-of-balance mass within the basket based on the measured movement, and halting the basket in response to determining the out-of-balance mass.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

DETAILED DESCRIPTION

Figure 1:
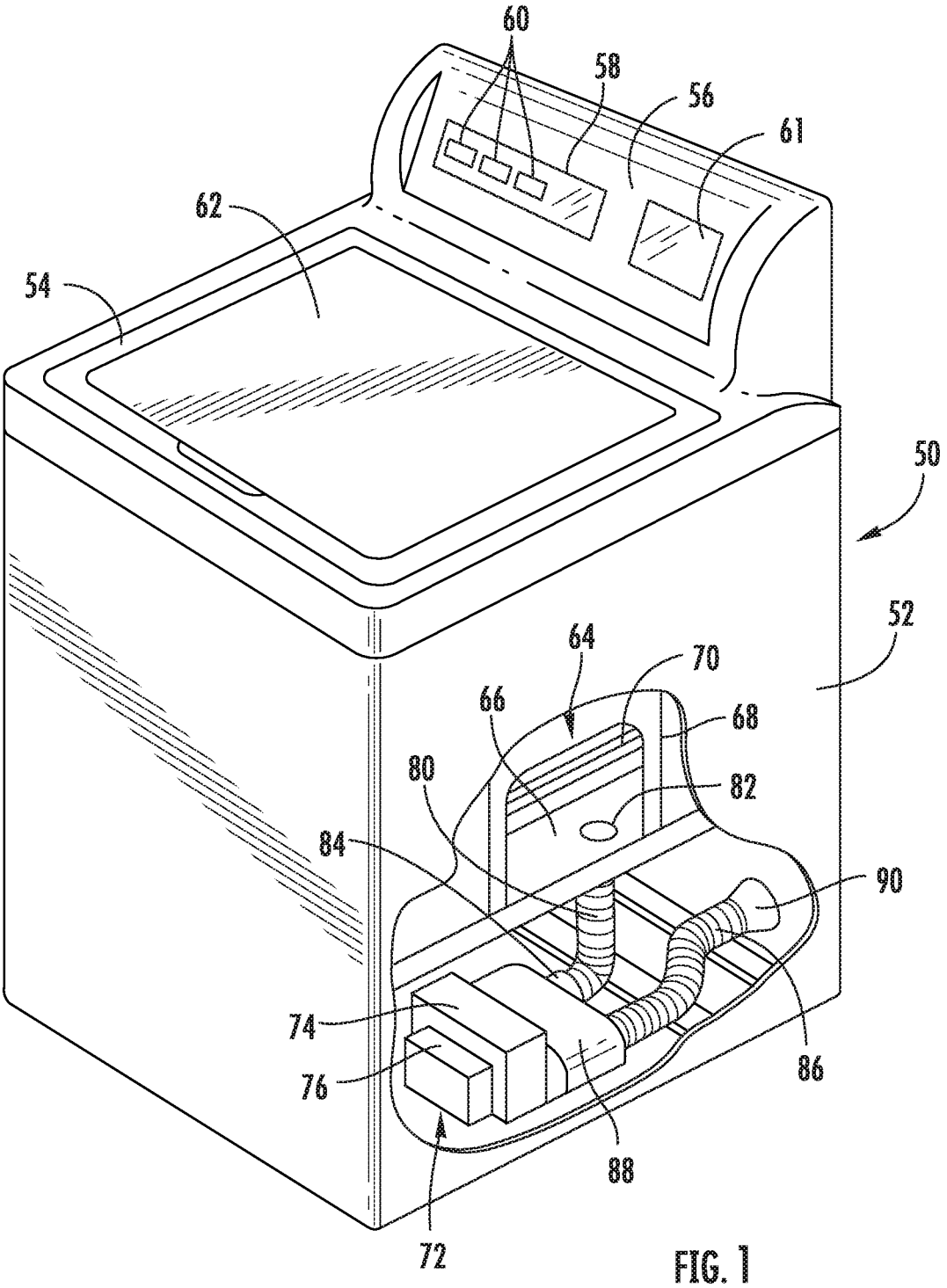
FIG. 1 provides a perspective view of a washing machine appliance, with a portion of a cabinet of the washing machine appliance shown broken away in order to reveal certain interior components of the washing machine appliance, according to exemplary embodiments of the present disclosure.

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope of the invention. For instance, features illustrated or described as part of one embodiment can be used with another embodiment to yield a still further embodiment. Thus, it is intended that the present invention covers such modifications and variations as come within the scope of the appended claims and their equivalents.

As used herein, terms of approximation, such as "approximately," "substantially," or "about," refer to being within a ten percent margin of error. The terms "first," "second," and "third" may be used interchangeably to distinguish one component or datum from another and are not intended to signify location or importance of the individual components or data.

FIG. 1 provides a perspective view partially broken away of a washing machine appliance 50 according to an exemplary embodiment of the present disclosure. As may be seen in FIG. 1, washing machine appliance 50 includes a cabinet 52 and a cover 54. A backsplash 56 extends from cover 54, and a control panel 58, including a plurality of input selectors 60, is coupled to backsplash 56. Control panel 58 and input selectors 60 collectively form a user interface input for operator selection of machine cycles and features, and in one embodiment a display 61 indicates selected features, a countdown timer, and other items of interest to machine users. A lid 62 is mounted to cover 54 and is rotatable about a hinge (not shown) between an open position (not shown) facilitating access to a wash tub 64 located within cabinet 52, and a closed position (shown in FIG. 1) forming an enclosure over wash tub 64.

As illustrated in FIG. 1, washing machine appliance 50 is a vertical axis washing machine appliance. While the present disclosure is discussed with reference to an exemplary vertical axis washing machine appliance, those of ordinary skill in the art, using the disclosures provided herein, should understand that the subject matter of the present disclosure is equally applicable to other washing machine appliances.

Tub 64 includes a bottom wall 66 and a sidewall 68. Moreover, a basket 70 is rotatably mounted within wash tub 64. In some embodiments, a pump assembly 72 is located beneath tub 64 and basket 70 for gravity assisted flow when draining tub 64. Pump assembly 72 includes a pump 74 and a motor 76. A pump inlet hose 80 extends from a wash tub outlet 82 in tub bottom wall 66 to a pump inlet 84, and a pump outlet hose 86 extends from a pump outlet 88 to an appliance washing machine water outlet 90 and ultimately to a building plumbing system discharge line (not shown) in flow communication with outlet 90.

Figure 2:
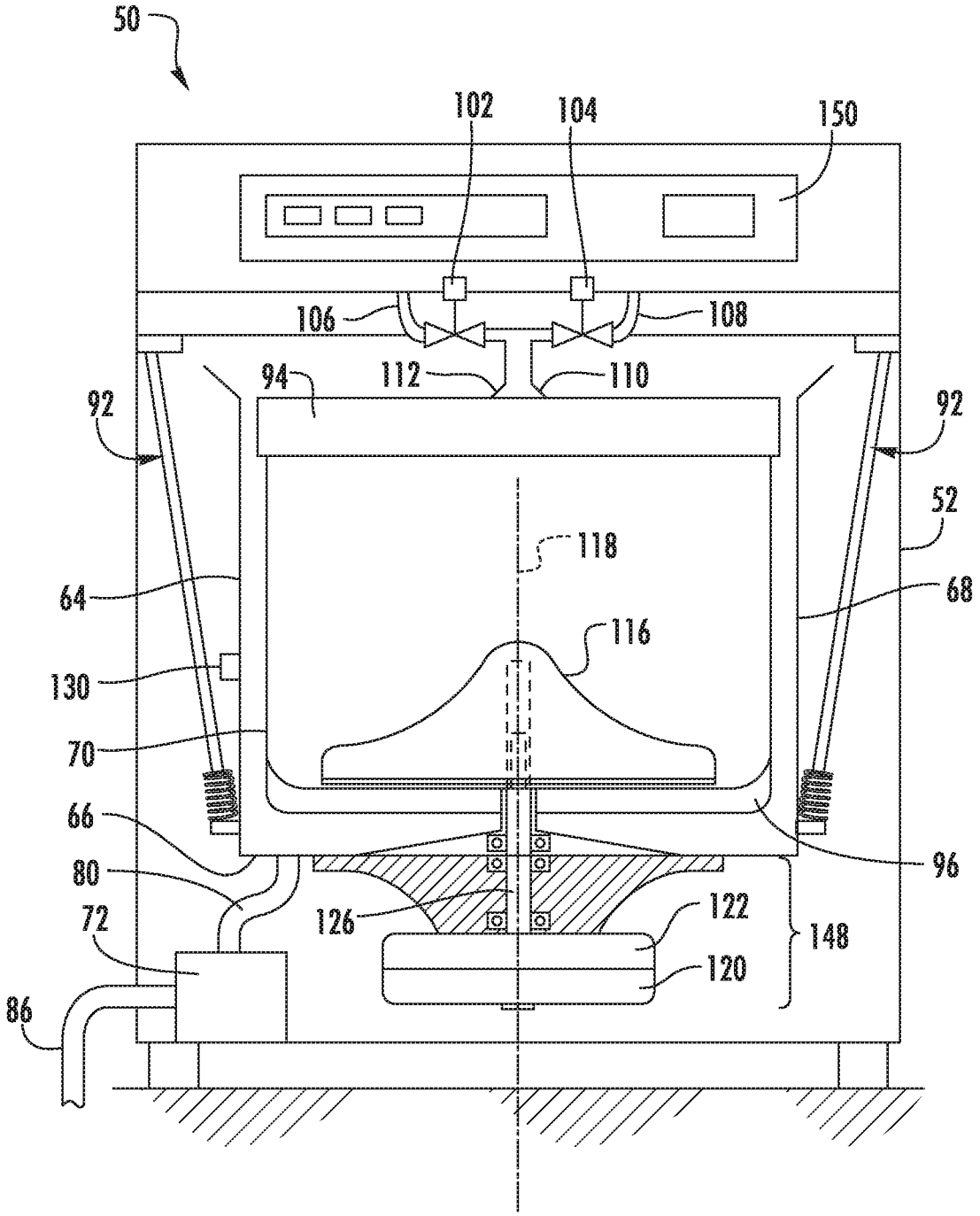
FIG. 2 provides a front elevation schematic view of various components of the exemplary washing machine appliance of FIG. 1.

FIG. 2 provides a front elevation schematic view of certain components of washing machine appliance 50 including wash basket 70 movably disposed and rotatably mounted in wash tub 64 in a spaced apart relationship from tub side wall 68 and tub bottom 66. Basket 70 includes a plurality of perforations therein to facilitate fluid communication between an interior of basket 70 and wash tub 64.

In some embodiments, a hot liquid valve 102 and a cold liquid valve 104 deliver liquid, such as water, to basket 70 and wash tub 64 through a respective hot liquid hose 106 and cold liquid hose 108. Liquid valves 102, 104 and liquid hoses 106, 108 together form a liquid supply connection for washing machine appliance 50 and, when connected to a building plumbing system (not shown), provide a fresh water supply for use in washing machine appliance 50. Liquid valves 102, 104 and liquid hoses 106, 108 are connected to a basket inlet tube 110, and liquid is dispersed from inlet tube 110 through a nozzle assembly 112 having a number of openings therein to direct washing liquid into basket 70 at a given trajectory and velocity. A dispenser (not shown in FIG. 2), may also be provided to produce a liquid or wash solution by mixing fresh water with a known detergent and/or other additive for cleansing of articles in basket 70.

Figure 3:
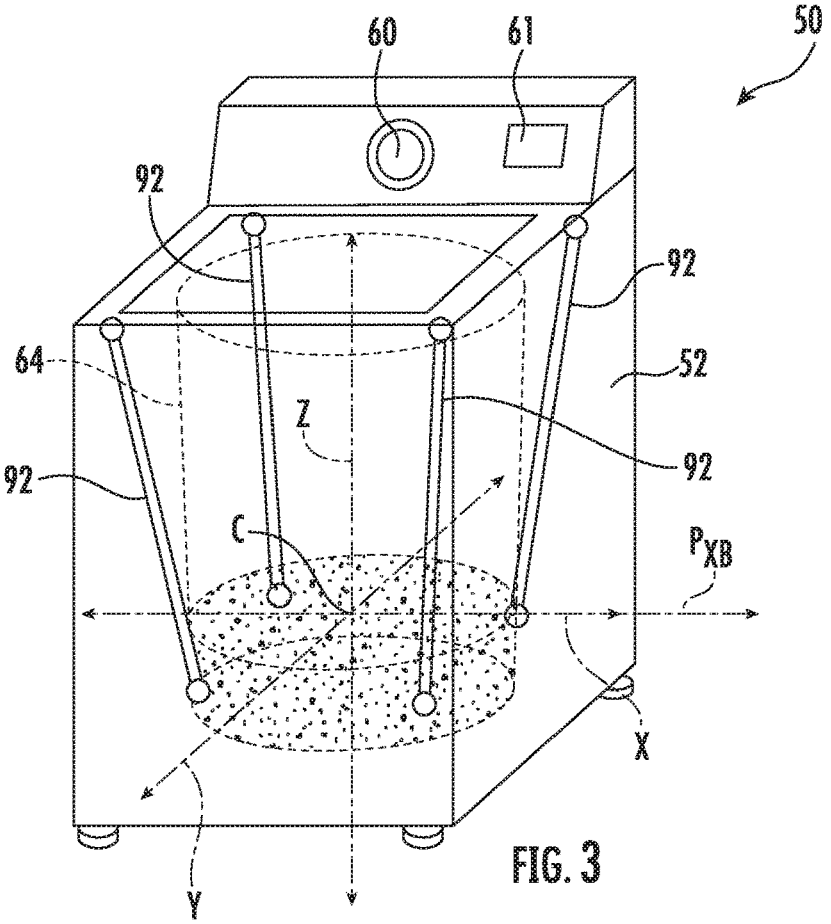
FIG. 3 provides a perspective schematic view of components of a washing machine appliance in accordance with exemplary embodiments of the present disclosure.
Figure 4:
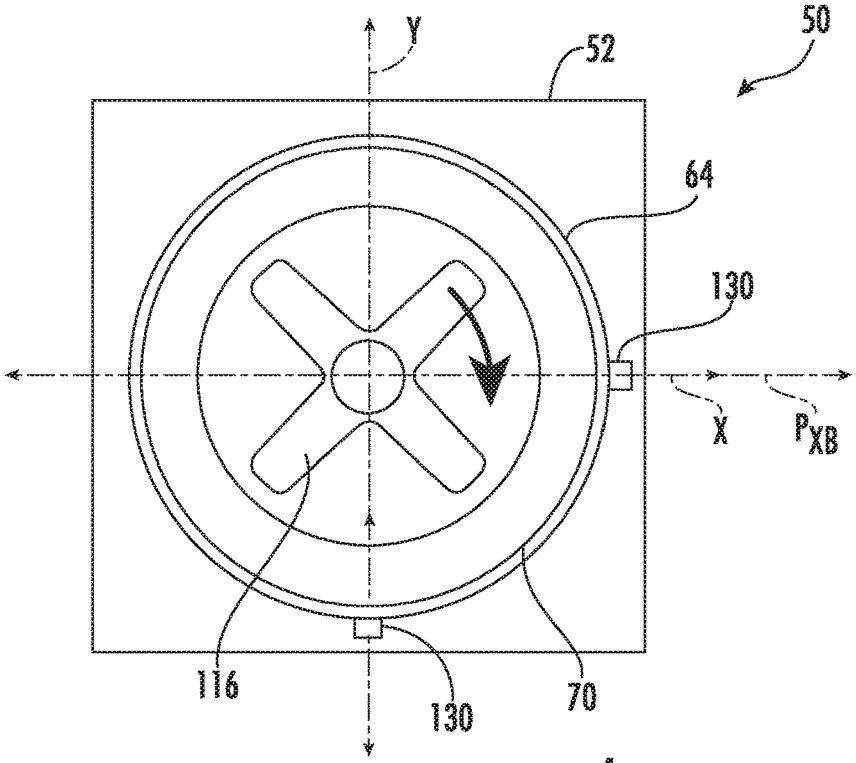
FIG. 4 provides a top view of an agitation element, basket, and tub within a cabinet of a washing machine appliance in accordance with exemplary embodiments of the present disclosure.

Referring now to FIGS. 2 through 4, an agitation element 116, such as a vane agitator, impeller, auger, or oscillatory basket mechanism, or some combination thereof, may be disposed in basket 70 to impart an oscillatory motion to articles and liquid in basket 70. In various exemplary embodiments, agitation element 116 may be a single action element (oscillatory only), double action (oscillatory movement at one end, single direction rotation at the other end) or triple action (oscillatory movement plus single direction rotation at one end, single direction rotation at the other end). As illustrated, agitation element 116 is oriented to rotate about a vertical axis 118.

Basket 70 and agitation element 116 are driven by a motor 120 through a transmission and clutch system 122. The motor 120 drives shaft 126 to rotate basket 70 within wash tub 64. Clutch system 122 facilitates driving engagement of basket 70 and agitation element 116 for rotatable movement within wash tub 64, and clutch system 122 facilitates relative rotation of basket 70 and agitation element 116 for selected portions of wash cycles. Motor 120 and transmission and clutch system 122 collectively are referred herein as a motor assembly 148.

Basket 70, tub 64, and motor assembly 148 are supported by a vibration dampening suspension system. The dampening suspension system can include one or more suspension assemblies 92 coupled between and to the cabinet 52 and wash tub 64. Typically, four suspension assemblies 92 are utilized, and are spaced apart about the wash tub 64. For example, each suspension assembly 92 may be connected at one end proximate a corner of the cabinet 52 and at an opposite end to the wash tub 64. The washer can include other vibration dampening elements, such as a balance ring 94 disposed around the upper circumferential surface of the wash basket 70. The balance ring 94 can be used to counterbalance an out of balance condition for the wash machine as the basket 70 rotates within the wash tub 64. The wash basket 70 could also include a balance ring 96 located at a lower circumferential surface of the wash basket 70.

A dampening suspension system generally operates to dampen dynamic motion as the wash basket 70 rotates within the tub 64. The dampening suspension system has various natural operating frequencies of the dynamic system. These natural operating frequencies are referred to as the modes of suspension for the washing machine. For instance, the first mode of suspension for the washing machine occurs when the dynamic system including the wash basket 70, tub 64, and suspension system are operating at the first resonant or natural frequency of the dynamic system.

Operation of washing machine appliance 50 is controlled by a controller 150 that is operatively coupled (e.g., electrically coupled or connected) to the user interface input located on washing machine backsplash 56 (FIG. 1) for user manipulation to select washing machine cycles and features. In response to user manipulation of the user interface input, controller 150 operates the various components of washing machine appliance 50 to execute selected machine cycles and features.

Controller 150 may include a memory (e.g., non-transitory storage media) and microprocessor, such as a general or special purpose microprocessor operable to execute programming instructions or micro-control code associated with a washing operation or cycle. The memory may represent random access memory such as DRAM, or read only memory such as ROM or FLASH. In one embodiment, the processor executes programming instructions stored in memory (e.g., as software). The memory may be a separate component from the processor or may be included onboard within the processor. Alternatively, controller 150 may be constructed without using a microprocessor, e.g., using a combination of discrete analog and/or digital logic circuitry (such as switches, amplifiers, integrators, comparators, flip-flops, AND gates, and the like) to perform control functionality instead of relying upon software. Control panel 58 and other components of washing machine appliance 50 (such as motor assembly 148 and measurement devices 130—discussed herein) may be in communication with controller 150 via one or more signal lines or shared communication busses to provide signals to and/or receive signals from the controller 150. Optionally, a measurement device 130 may be included with controller 150. Moreover, measurement devices 130 may include a microprocessor that performs the calculations specific to the measurement of motion with the calculation results being used by controller 150.

In an illustrative embodiment, laundry items are loaded into basket 70, and washing operation is initiated through operator manipulation of control input selectors 60 (shown in FIG. 1). Tub 64 is filled with liquid such as water and mixed with detergent to form a wash fluid, and basket 70 is agitated with agitation element 116 for cleansing of laundry items in basket 70. That is, agitation element 116 is moved back and forth in an oscillatory back and forth motion, while basket 70 remains generally stationary (i.e., not actively rotated). In the illustrated embodiment, agitation element 116 is rotated clockwise a specified amount about the vertical axis 118 of the machine, and then rotated counterclockwise by a specified amount. The clockwise/counterclockwise reciprocating motion is sometimes referred to as a stroke, and the agitation phase of the wash cycle constitutes a number of strokes in sequence. Acceleration and deceleration of agitation element 116 during the strokes imparts mechanical energy to articles in basket 70 for cleansing action. The strokes may be obtained in different embodiments with a reversing motor, a reversible clutch, or other known reciprocating mechanism. After the agitation phase of the wash cycle is completed, tub 64 is drained with pump assembly 72. Laundry articles can then be rinsed by again adding liquid to tub 64. Depending on the particulars of the washing operation selected by a user, agitation element 116 may again provide agitation within basket 70. After a rinse cycle, tub 64 is again drained, such as through use of pump assembly 72. After liquid is drained from tub 64, one or more spin cycles may be performed. In particular, a spin cycle may be applied after the agitation phase and/or after the rinse phase in order to wring excess wash fluid from the articles being washed. During a spin cycle, basket 70 is rotated at relatively high speeds, such as between approximately 450 and approximately 1300 revolutions per minute.

In specific embodiments, one or more measurement devices 130 are provided in the washing machine appliance 50 for measuring movement of the tub 64 during one or more portions of an operative cycle (e.g., a wash cycle, rinse cycle, spin cycle, etc.). As will be described in greater detail below, movement may be measured as one or more displacement readings (e.g., displacement amplitudes), detected at the one or more measurement devices 130. Measurement devices 130 may measure a variety of suitable variables, which can be correlated to movement of the tub 64. The movement measured by such devices 130 can be utilized to monitor the load balance state of the tub 64 (e.g., during to a spin cycle and/or prior to reaching a programmed maximum basket speed), and to facilitate movement or acceleration in particular manners and/or for particular time periods to prevent damage or undesired operations.

A measurement device 130 in accordance with the present disclosure may include an accelerometer which measures translational motion, such as acceleration along one or more directions. Additionally or alternatively, a measurement device 130 may include a gyro sensor, encoder, or other measurement devices, which measures rotational motion, such as rotational velocity about an axis. Also additionally or alternatively, a measurement device 130 may be provided as or include an optical sensor, an inductive sensor, a Hall effect sensor, a potentiometer, a load cell, a strain gauge, or any other suitable device 130 capable of measuring, either directly or indirectly, translational and/or rotational movement.

In some embodiments, measurement device 130 is mounted to the tub 64 (e.g., bottom wall 66 or a sidewall 68 thereof) to sense movement of the tub 64 relative to the cabinet 52 by measuring uniform periodic motion, non-uniform periodic motion, and/or excursions of the tub 64 during appliance 50 operation.

In exemplary embodiments, a measurement device 130 may include at least one gyro sensor and/or at least one accelerometer. The measurement device 130, for example, may be a printed circuit board which includes the gyro sensor and accelerometer thereon. The measurement device 130 may be mounted to the tub 64 (e.g., via a suitable mechanical fastener, adhesive, etc.) and may be oriented such that the various sub-components (e.g., the gyro sensor and accelerometer) are oriented to measure movement along or about particular directions. Notably, the gyro sensor and accelerometer in exemplary embodiments may be mounted to the tub 64 at a single location (e.g., the location of the printed circuit board or other component of the measurement device 130 on which the gyro sensor and accelerometer are grouped). Such positioning at a single location advantageously reduces the costs and complexity (e.g., due to additional wiring, etc.) of out-of-balance detection, while still providing relatively accurate out-of-balance detection as discussed herein. Alternatively, however, the gyro sensor and accelerometer need not be mounted at a single location. For example, a gyro sensor located at one location on tub 64 can measure the rotation of an accelerometer located at a different location on tub 64, because rotation about a given axis is the same everywhere on a solid object such as tub 64.

As illustrated in FIGS. 3 and 4, tub 64 may define an X-axis, a Y-axis and a Z-axis that are mutually orthogonal to each other. The Z-axis may extend along a longitudinal direction, and may thus be coaxial or parallel with the vertical axis 118 when the tub 64 and basket 70 are balanced. The Z-axis may additionally be a central axis, defining the center of the tub 64 in planes defined by the X-axis and Y-axis (as illustrated, for example, in FIG. 4). Movement of the tub 64 measured by measurement devices 130 (such as a directional component of such movement) may, in exemplary embodiments, be an indirect measurement measured as a displacement amplitude along a direction perpendicular or approximately perpendicular to a vector that passes through a center (e.g., center of gravity, C) of the tub 64. Advantageously, a displacement amplitude perpendicular to the Z-axis at the center of gravity C may be generally proportional to an imbalance within the tub 64.

In some embodiments, movement is measured as one or more displacements amplitudes. Optionally, the displacement amplitudes may occur in discrete channels of motion (e.g., as distinct directional components of movement). For instance, a displacement amplitude may correspond to one or more indirectly measured movement components along a direction (e.g., vector) perpendicular or approximately perpendicular to the center C of the tub 64. Such movement components may, for example, occur in a plane defined by the X-axis and Y-axis (i.e., the X-Y plane) or in a plane perpendicular to the X-Y plane. Movement of the tub 64 along the particular direction may be calculated using the indirect measurement component and other suitable variables, such as a horizontal and/or radial offset distance along the vector from the measurement device 130 to the center C of the tub 64. Additionally or alternatively, the displacement amplitudes may correspond to one or more directly measured movement components. Such movement components may, for example, occur in the X-Y plane or in a plane perpendicular to the X-Y plane.

The measured movement of the tub 64 in accordance with exemplary embodiments of the present disclosure, such as those requiring one or more gyro sensors and one or more accelerometers, may advantageously be calculated based on the movement components measured by the accelerometer and/or gyro sensor of the measurement device(s) 130. For example, a displacement amplitude of the tub 64 may be detected along a linear displacement vector $P_{XB}$ from the center C in the X-Y plane. Displacement amplitude along vector $P_{XB}$ may be calculated from detected movement by the accelerometer at measurement device 130 (e.g., via double integration of detected acceleration data). For example, displacement amplitudes along vectors defined in an X-Y plane, such as $P_{XB}$, may represent the radius of a substantially circular (e.g., elliptical, orbital, or perfectly circular) motion caused by the rotation of an imbalanced load so that maximum and minimum values of displacement amplitude occur as the substantially circular motion aligns with the direction of the vector.

Figure 5:
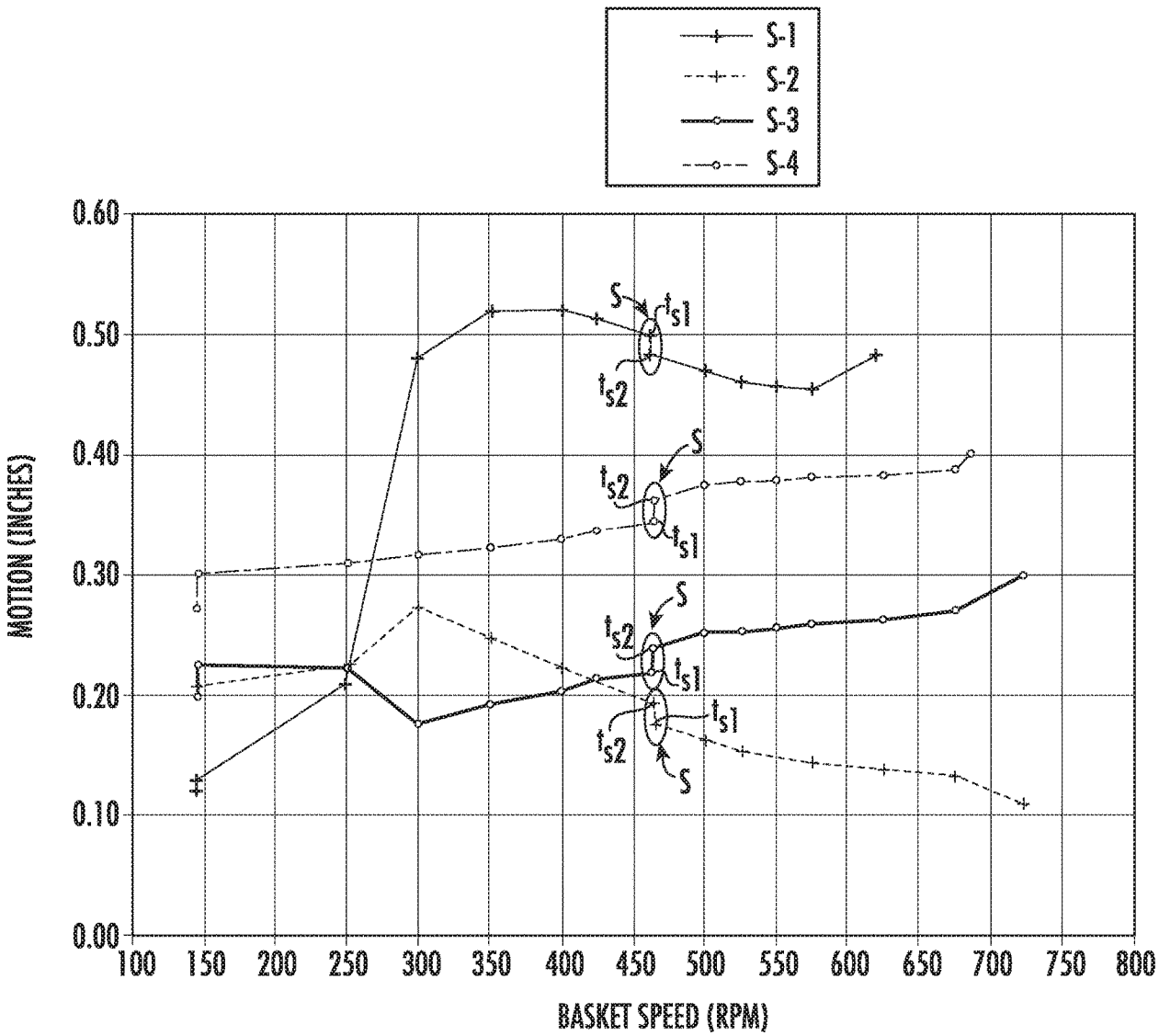
FIG. 5 provides a graph illustrating movement of a wash tub relative to rotation speed of a basket for an exemplary washing machine appliance operating with four unique loads.

Turning briefly to FIG. 5, a graph is provided that illustrates a measured movement (e.g., translational movement perpendicular to a Z-axis, such that could be measured in inches) of a wash tub 64 (FIG. 4) relative to rotation speed (e.g., in rotations per minute—RPM—about the vertical axis 118) of a basket 70 (FIG. 4). Specifically, FIG. 5 illustrates measured movement as a function of basket speed for four unique loads 5-1, 5-2, 5-3, and 5-4 during an exemplary operative cycle (e.g., spin cycle) of washing machine appliance 50. Generally, loads 5-1 and 5-2 illustrate two exemplary testing conditions wherein a volume of articles including a wet load of fabrics with some imbalance was provided in basket 70. Loads 5-3 and 5-4 illustrate two exemplary testing conditions wherein a large volume of contained water, specifically a large bag of water, was included in the load of wet articles placed within the basket 70. In this test data the large bag of water generally represents water trapped by a waterproof item.

Each point marked on the lines of a load may represent a measured movement detected at a predetermined time of a spin cycle. Optionally, the measured movement may represent or be provided as a displacement amplitude. For instance, the displacement amplitude may be a single displacement amplitude value, maximum displacement amplitude value, or a mean value of a plurality of displacement amplitudes (e.g., detected during the predetermined time). Additionally or alternatively, the predetermined time may represent or be provided as a singular instance or a set duration of time (e.g., measured in seconds) of the spin cycle. In the case of the specific loads 5-1, 5-2, 5-3, and 5-4, each point represents a mean value of a plurality of displacement amplitudes detected over a set duration during which basket rotated at the corresponding speed.

The spin cycle of FIG. 5 may immediately follow an agitation cycle or rinse cycle (e.g., after water is initially drained from a tub 64 via pump assembly 72). As shown, when an imbalanced load that does not include a large contained volume of water (e.g., 5-1 or 5-2) is provided, movement (e.g., radial movement perpendicular to a Z-axis) at tub 64 may decrease at a predetermined dwell speed S (e.g., between two points $t_{s1}$ and $t_{s2}$, each corresponding to a unique predetermined time). By contrast, when a load that includes a large contained volume of water (e.g., 5-3 or 5-4) is provided, movement (e.g., radial movement perpendicular to a Z-axis) at tub 64 may increase at a predetermined dwell speed S (e.g., between two points $t_{s1}$ and $t_{s2}$, each corresponding to a unique predetermined time). Additionally or alternatively, when a load that includes a large contained volume of water (e.g., 5-3 or 5-4) is provided, movement (e.g., radial movement perpendicular to a Z-axis) at tub 64 may generally increase following the dwell speed S and subsequent to $t_{s1}$ and $t_{s2}$ (e.g., as the spin speed increases above the dwell speed S). Advantageously, the predetermined dwell speed may be notably lower than the relatively high speed that basket 70 may reach during the illustrated operative cycle. As determined, the movement of tub (e.g., tub 64) increases when trapped water (e.g., a large volume of contained water) occupies a portion of the overall volume of a load because the rest of the volume of the load begins shedding water that was previously counterbalancing the trapped water.

Figure 6:
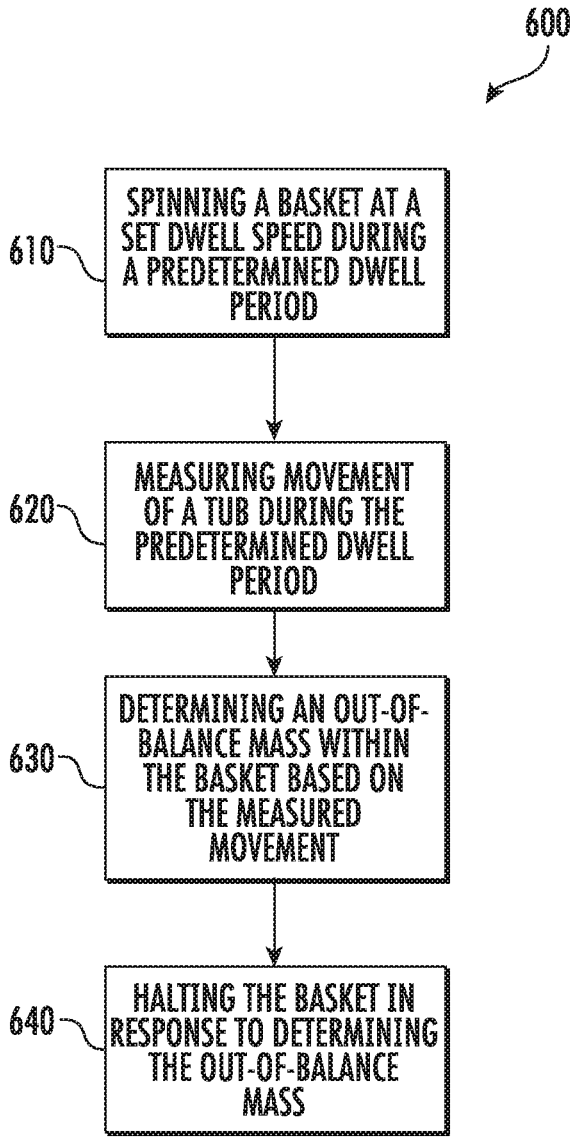
FIG. 6 provides a flow chart illustrating a method for operating a washing machine appliance in accordance with exemplary embodiments of the present disclosure.

Referring now to FIG. 6, various methods may be provided for use with washing machine appliances (e.g., washing machine appliance 50) in accordance with the present disclosure. In general, the various steps of methods as disclosed herein may, in exemplary embodiments, be performed by the controller 150 as part of an operative cycle that the controller 150 is configured to initiate (e.g., a wash cycle, a rinse cycle, a spin cycle, etc.). During such methods, controller 150 may receive inputs and transmit outputs from various other components of the appliance 50. For example, controller 150 may send signals to and receive signals from motor assembly 148 (including the motor 120), control panel 58, one or more measurement device 130, pump assembly 72, and/or valves 102, 104. In particular, the present disclosure is further directed to methods, as indicated by reference number 600, for operating a washing machine appliance. Such methods advantageously facilitate monitoring of load balance states, detection of out-of-balance conditions, and reduction of out-of-balance conditions prior to maximum or relatively high spin speeds being reached by the basket 70.

FIG. 6 depicts steps performed in a particular order for purpose of illustration and discussion. Those of ordinary skill in the art, using the disclosures provided herein, will understand that (except as otherwise indicated) the steps of any of the methods disclosed herein can be modified, adapted, rearranged, omitted, or expanded in various ways without deviating from the scope of the present disclosure.

As shown, at 610 the method 600 includes spinning the basket at a set dwell speed. For instance, the motor may rotate the basket within tub at the set dwell speed (e.g., in rotations per minute) for a predetermined time period (i.e., a predetermined amount of time).

In some such embodiments, 610 follows a previous cycle or phase. For instance, 610 may follow a step of flowing a volume of a liquid into the tub. The liquid may include water, and may further include one or more additives as discussed above. The water may be flowed through the hot liquid hose and/or cold liquid hose, the basket inlet tube, and nozzle assembly into the tub and onto articles that are disposed in the basket for washing. The volume of liquid may be dependent upon the size of the load of articles and other variables which may, for example, be input by a user interacting with the control panel and input selectors thereof. Optionally, the pump assembly may draw water (e.g., at least a portion of the volume of liquid) away from the tub before spinning begins.

Generally, the set dwell speed is lower than a programmed maximum basket speed. As an example, the dwell speed may be approximately 450 RPM. Additionally or alternatively, the programmed maximum basket speed of the spin may be greater than or equal to approximately 500 RPM (e.g., greater than or equal to approximately 625 RPM, 675 RMP, or 725 RPM).

At 620, the method 600 includes measuring movement of the tub. In particular, 620 occurs, at least in part, during the predetermined dwell period of 610. Thus, the basket may continue to rotate at the dwell speed, which is lower than a programmed maximum basket speed of the spin cycle. As described above, movement may be measured using at least one of an accelerometer, a gyro sensor, an optical sensor, an inductive sensor, a Hall effect sensor, a potentiometer, a load cell, or a strain gauge. In some such embodiments, movement may thus be measured along a vector in a plane defined by the X-axis and Y-axis.

In certain embodiments, movement is measured repeatedly during the spin cycle. Specifically, a unique value of measurement is obtained for movement at least two different times (e.g., two singular discrete instances or two discrete durations of time) during or following the dwell period. Optionally, a discrete duration of time may be greater than or equal to 2 seconds. Additionally or alternatively, a discrete duration of time may be less than or equal to 15 seconds.

In some embodiments, movement is measured as a discrete first and second displacement amplitude. As an example, both the first and second displacement amplitudes may be determined during (and/or from movement occurring during) the dwell period. However, the second displacement amplitude may be determined subsequent to (and/or from movement subsequent to the movement of) the first displacement amplitude. As an additional or alternative example, a first displacement amplitude may be determined during (and/or from movement occurring during) the dwell period while the second displacement amplitude may be determined following the dwell period, such as during an accelerating period during which the spin speed of the basket is increasing above the dwell speed (e.g., and prior to reaching the basket reaching a programmed maximum basket speed).

As described above, displacement amplitudes may be detected using an accelerometer and/or a gyro sensor. Thus, the first displacement amplitude and/or the second displacement amplitude may be detected using an accelerometer or a gyro sensor.

As further described above, the first and second displacement amplitudes may be determined from a plurality of displacement amplitudes over a corresponding set duration of time (e.g., amplitudes at discrete instances over the corresponding set duration of time). As an example, determining the first displacement amplitude may include detecting a first plurality of displacement amplitudes over a first set duration of time. As an additional or alternative example, determining the second displacement amplitude may include detecting a second plurality of displacement amplitudes over a second set duration of time (e.g., that is subsequent to the first set duration of time).

Optionally, one or both of the first and second displacement amplitudes may be determined as a discrete single value of the corresponding plurality of displacement amplitudes. As an example, the first displacement value may be a single value (e.g., maximum value) obtained from the first plurality of displacement amplitude values. As an additional or alternative example, the second displacement value may be a single value (e.g., maximum value) obtained from the second plurality of displacement amplitude values. For the first and/or second displacement amplitudes, the single value may be any suitable value selected from the corresponding plurality of displacement amplitude values (or a filtered subset thereof), such as a maximum value. Thus, determining the first or second displacement amplitude may include identifying a maximum value from the corresponding plurality of displacement amplitude values.

Additionally or alternatively, one or both of the first and second displacement amplitudes may be determined as a new value that is calculated from the corresponding plurality of displacement amplitudes. As an example, the first displacement value may be a new value calculated from the first plurality of displacement amplitude values. As an additional or alternative example, the second displacement value may be a new value calculated from the second plurality of displacement amplitude values. For the first and/or second displacement amplitudes, the corresponding new value may be any suitable value obtained using the corresponding plurality of displacement amplitude values (or a filtered subset thereof), such as a mean or median value. Thus, determining the first or second displacement amplitude may include calculating a new value (e.g., mean value) from the corresponding plurality of displacement amplitude values.

At 630, the method 600 includes determining an out-of-balance mass, such as a volume of trapped water or wash fluid, within the basket based on the measured movement (e.g., as obtained at 620). As an example, and as described above, an increase in displacement amplitude during or following the dwell period may indicate an out-of-balance mass is present within the basket (i.e., an out-of-balance condition is present).

In some embodiments, 630 includes calculating an increase in displacement. For instance, the difference between the first displacement amplitude and the second displacement amplitude maybe calculated (e.g., as a percentage). When an increase in displacement is calculated, the increase in displacement may be compared to a predetermined variation (e.g., limit). Optionally, the predetermined variation may be ten percent. A difference that is greater than or equal to the predetermined variation may correspond to a determination of an out-of-balance mass. Thus, 630 may include calculating an increase in displacement that is greater than or equal to ten percent.

Optionally, increases in displacement may be correlated to a specific mass (e.g., mass value or range of mass values—such that might be predetermined via testing of previous exemplary units). A chart, formula, or look-up table may be provided correlating calculated increases in displacement to specific masses. In some such embodiments, 630 includes correlating the calculated increase in displacement to a specific mass.

Although an increase in displacement is described above, it is noted that a decrease in displacement may indicate a load with a declining imbalance that is unlikely to contain trapped water, as described above. Thus, determination that displacement amplitude decreases from the first displacement amplitude to the second displacement amplitude (or that an increase in displacement amplitude fails to meet a predetermined variation), may result in continued execution of the spin cycle (e.g., to completion) and/or repetition of the previous steps.

At 640, the method 600 includes halting the basket in response to detecting an increase in imbalance very likely caused by trapped water at 630. For instance, an electrical current through the washing machine appliance (e.g., to one or more components within the washing machine appliance, such as the motor) may be prevented. Optionally, 640 may include preventing rotation of a motor rotatably mounted to the rotation element (e.g., before the programmed end point or time of the spin cycle).

Additionally or alternatively, at 640 an alert signal is transmitted to the user interface or a personal device (e.g., computer, tablet, phone, etc.). The alert signal may initiate an audio or visual command communicating and corresponding to the detected out-of-balance mass. Thus, a user may be made aware of the out-of-balance mass (e.g., such that a trapped or contained volume of water may be released or the washing operation may be ended altogether prior to completion of the spin cycle).

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A washing machine appliance comprising:

a cabinet;

a tub housed within the cabinet;

a basket rotatably mounted within the tub;

a measurement device attached to the tub;

a motor in mechanical communication with the basket, the motor configured to selectively rotate the basket within the tub; and a controller in operative communication with the motor and the measurement device, the controller configured to initiate an operation cycle comprising spinning the basket at a set dwell speed during a predetermined dwell period, measuring movement of the tub during the predetermined dwell period, determining an out-of-balance mass within the basket based on the measured movement, and halting the basket in response to determining the out-of-balance mass.

2. The washing machine appliance of claim 1, further comprising at least one of an accelerometer, a gyro sensor, an optical sensor, an inductive sensor, a Hall effect sensor, a potentiometer, a load cell, or a strain gauge in operative communication with the controller, wherein movement is measured using at least one of the accelerometer, the gyro sensor, the optical sensor, the inductive sensor, the Hall effect sensor, the potentiometer, the load cell, or the strain gauge.

3. The washing machine appliance of claim 1, wherein the tub defines an X-axis, a Y-axis, and a Z-axis which are mutually orthogonal to each other, the Z-axis extending along a longitudinal direction and defining a center of the tub, and wherein movement is measured along a vector in a plane defined by the X-axis, and Y-axis.

4. The washing machine appliance of claim 1, wherein measuring movement comprises determining a first displacement amplitude of the tub during the predetermined dwell period, and determining a second displacement amplitude of the tub subsequent to detecting the first displacement amplitude.

5. The washing machine appliance of claim 4, wherein measuring the first displacement amplitude comprises detecting movement of the tub using an accelerometer or a gyro sensor.

6. The washing machine appliance of claim 4, wherein determining the first displacement amplitude of the tub comprises detecting a plurality of displacement amplitudes values over a set duration of time.

7. The washing machine appliance of claim 6, wherein the first displacement value is a single value of the plurality of displacement amplitude values.

8. The washing machine appliance of claim 6, wherein the first displacement value is a new value calculated from the plurality of displacement amplitude values.

9. The washing machine appliance of claim 4, wherein determining an out-of-balance mass comprises calculating an increase in displacement greater than or equal to a predetermined variation between the first displacement amplitude and the second displacement amplitude.

10. The washing machine appliance of claim 9, wherein the predetermined variation is ten percent.

* * * * *